US007075432B2

(12) United States Patent
Roberts et al.

(10) Patent No.: US 7,075,432 B2
(45) Date of Patent: Jul. 11, 2006

(54) METHOD AND SYSTEM FOR MONITORING FOOD TRAY ACTIVITY

(75) Inventors: Stuart J. Roberts, Suffern, NY (US); John Demetrops, Stony Point, NY (US); Vladimir Schuster, New City, NY (US)

(73) Assignee: Monismart Systems LLC, Stony Point, NY (US)

( * ) Notice: Subject to any disclaimer, the term of this patent is extended or adjusted under 35 U.S.C. 154(b) by 0 days.

(21) Appl. No.: 10/340,272

(22) Filed: Jan. 10, 2003

(65) Prior Publication Data

US 2004/0135689 A1 Jul. 15, 2004

(51) Int. Cl.
*G08B 13/14* (2006.01)

(52) U.S. Cl. ..... 340/568.1; 340/572.1

(58) Field of Classification Search ..... 340/568.1, 340/568.5, 568.7, 568.8, 572, 572.1
See application file for complete search history.

(56) References Cited

U.S. PATENT DOCUMENTS

| | | | | |
|---|---|---|---|---|
| 4,598,275 | A * | 7/1986 | Ross et al. | 340/573.4 |
| 5,708,423 | A * | 1/1998 | Ghaffari et al. | 340/5.8 |
| 6,102,162 | A | 8/2000 | Teicher | 186/39 |
| 6,107,929 | A | 8/2000 | Amari | 340/687 |
| 6,152,321 | A | 11/2000 | Staar | 221/17 |
| 6,433,689 | B1 * | 8/2002 | Hovind et al. | 340/573.1 |
| 6,437,692 | B1 * | 8/2002 | Petite et al. | 340/540 |
| 6,714,121 | B1 * | 3/2004 | Moore | 340/10.3 |

* cited by examiner

*Primary Examiner*—Jeffery Hofsass
*Assistant Examiner*—Eric Blount
(74) *Attorney, Agent, or Firm*—Mathews, Shepherd, McKay & Bruneau, P.A.

(57) ABSTRACT

The invention relates to a method and system for monitoring tray activity in which a tray sensing device detects the presence of a tray in a given location. The tray can be a conventional tray for supporting food articles or can be supported or integral with a food cart. Information from the tray sensing device can be forwarded to a central information system. The central information system can display the information or activate an alarm. The alarm can be an audio or visual alert. The alarm can be deactivated upon removal of the tray from the given location or upon dispatching of personnel to the given location.

7 Claims, 4 Drawing Sheets

METHOD AND SYSTEM FOR MONITORING FOOD TRAY ACTIVITY

BACKGROUND OF THE INVENTION

1. Field of the Invention

The present invention relates to a method and system for monitoring food tray activity in which a sensor detects the presence or absence of a food tray in a hallway, such as in a hotel or motel.

2. Background of the Invention

Typically, food is delivered on trays to patrons in rooms of hotels by room service. Conventionally, after the patron has finished the food, the tray holding the used dishes and any uneaten food is placed in the hallway. Thereafter, the tray is picked up at some point by housekeeping or room service. The disadvantage of this method is that housekeeping or room service are unaware when the patron has finished the meal and do not know when to pick up the tray from outside the patron's room. Accordingly, it can be several hours before the tray is picked up resulting in unsightly trays being in the hallways and observed by other patrons of the hotel, as well as uneaten food having the possibility of spoiling and drawing pests or rodents.

It is desirable to provide a system for monitoring food tray activity wherein such system can alert a central location upon the placement of a food tray or cart in a hallway.

SUMMARY OF THE INVENTION

The invention relates to a method and system for monitoring tray activity in which a tray sensing device detects the presence of a tray in a given location. The tray can be a conventional tray for supporting food articles or can be supported or integral with a food cart. Information from the tray sensing device can be forwarded to a central information system. The central information system can display the information or activate an alarm. The alarm can be an audio or visual alert. The alarm can be deactivated upon removal of the tray from the given location or upon dispatching of personnel to the given location. The invention will be more fully described by reference to the following drawings.

DETAILED DESCRIPTION

Figure 1:
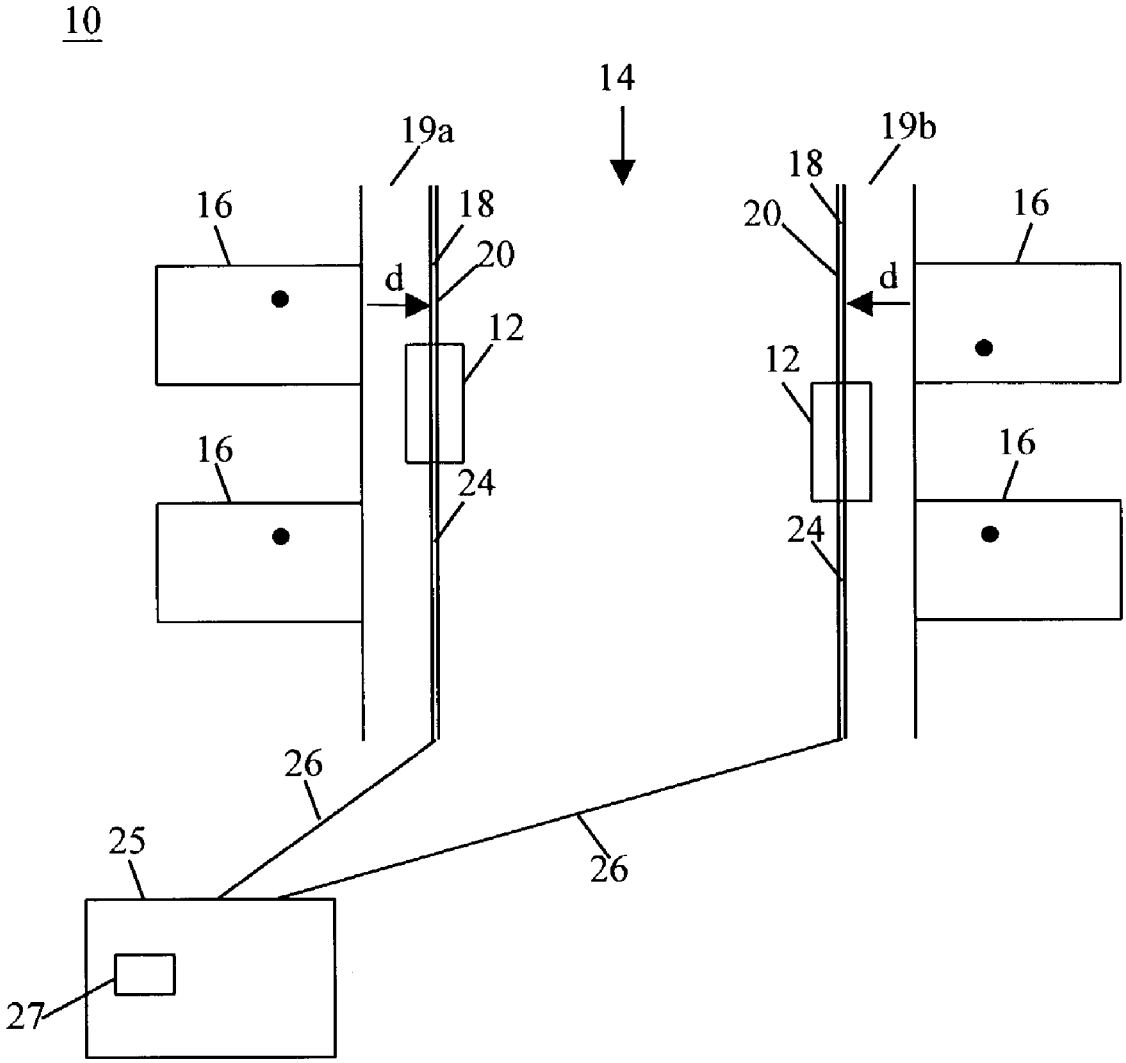
FIG. 1 is a schematic diagram of a system for monitoring tray activity in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts. Like reference numerals will be used in figures of the invention.

FIG. 1 is a schematic diagram of a system for monitoring tray activity 10 in accordance with the teachings of the present invention. Tray 12 is placed in hallway 14 outside of door 16. Tray 12 can be a tray for supporting food articles. Alternatively, tray 12 can be supported or integral with a food cart.

Tray sensing device 18 is positioned in hallway 14. Tray sensing device 18 can run the length of hallway 14 on either side 19*a* or 19*b* at a predetermined distance d from door 16. Distance d can be less than the width of tray 12 or at a selected distance to promote placement of tray 12 in the vicinity of tray sensing device 18 after placement of tray 12 in hallway 14 from door 16. Upon placement of tray 12 in the vicinity of sensing device 18, tray sensing device 18 senses the presence of tray 12.

Figure 2B:
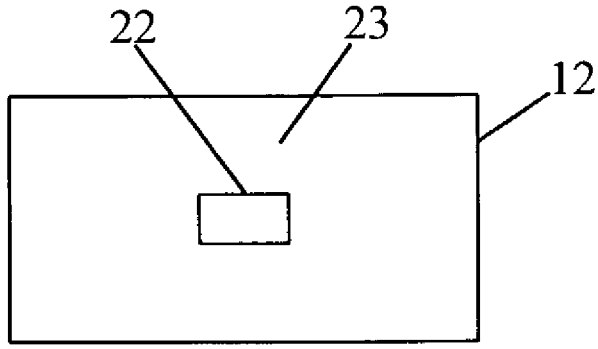
FIG. 2B is a schematic diagram of interaction of the tray sensor device with a tray sensing device associated with a hallway.
Figure 2A:
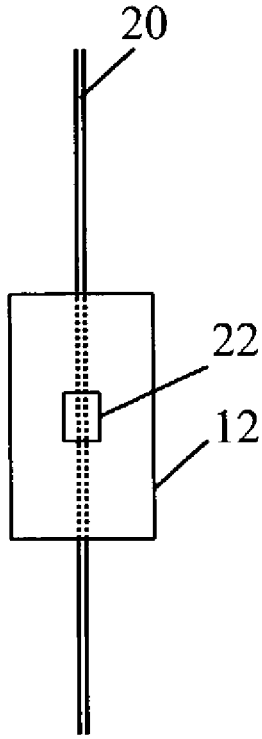
FIG. 2A is a schematic diagram of a tray indicating a tray sensor device.

FIGS. 2A and 2B illustrate an embodiment of tray sensing device 18. Tray sensing device 18 includes antenna 20. For example, antenna 20 can be a flat ribbon cable. Antenna 20 can be positioned underneath floor covering in hallway 14. Alternatively, antenna 20 can be positioned on the top surface of hallway 14 or integral with hallway 14.

Tray sensor device 22 is coupled to surface 23 of tray 12. For example, tray sensor device 22 can be a resonant device which is read by antenna 20. In an alternate embodiment, tray sensing device 18 and tray sensor device 22 can be a transmitter or receiver for respectively sending or receiving a signal for determining the presence or absence of tray 12 within a predetermined distance from tray sensing device 18. In this embodiment, the transmitter and receiver can communicate over a wireless or wired connection. It will be appreciated by those skilled in the art that other implementations of a tray sensor and tray sensing device can be used with the teachings of the present invention.

Upon sensing tray 12, tray sensing device 18 forwards control signal 24 to central information system 25 over communication path 26, as shown in FIG. 1. Control signal 24 can be generated at tray sensing device 18 to provide information about the location of tray 12 along hallway 14. Communication path 26 can be a wired or wireless connection. Central information system 25 can be a computer, such as a personal computer. Central information system 25 can be located at a central location such as in housekeeping or room service of a hotel.

Upon receipt of control signal 24, central information system 25 provides alarm 27 indicating tray 12 has been placed in hallway 14. Alarm 27 can be an audio or visual alert. Alarm 27 can be generated until personnel is dispatched to the location. Alarm 27 can be disabled at central information system 25 after the personnel has been dispatched. Alternatively, alarm 27 can be disabled after tray 12 has been removed from hallway 14. In this embodiment, central information system 25 deactivates alarm 27 upon receipt of a signal from tray sensing device 18 indicating that tray 12 has been removed from hallway 12. In an alternate embodiment, control signal 24 is continuously transmitted by tray sensing device 18 upon interaction with tray sensor 22 until tray 12 is removed from tray sensing device 18. Alarm 27 is continuously generated while control signal 24 is received until control signal 24 is no longer generated.

Figure 3:
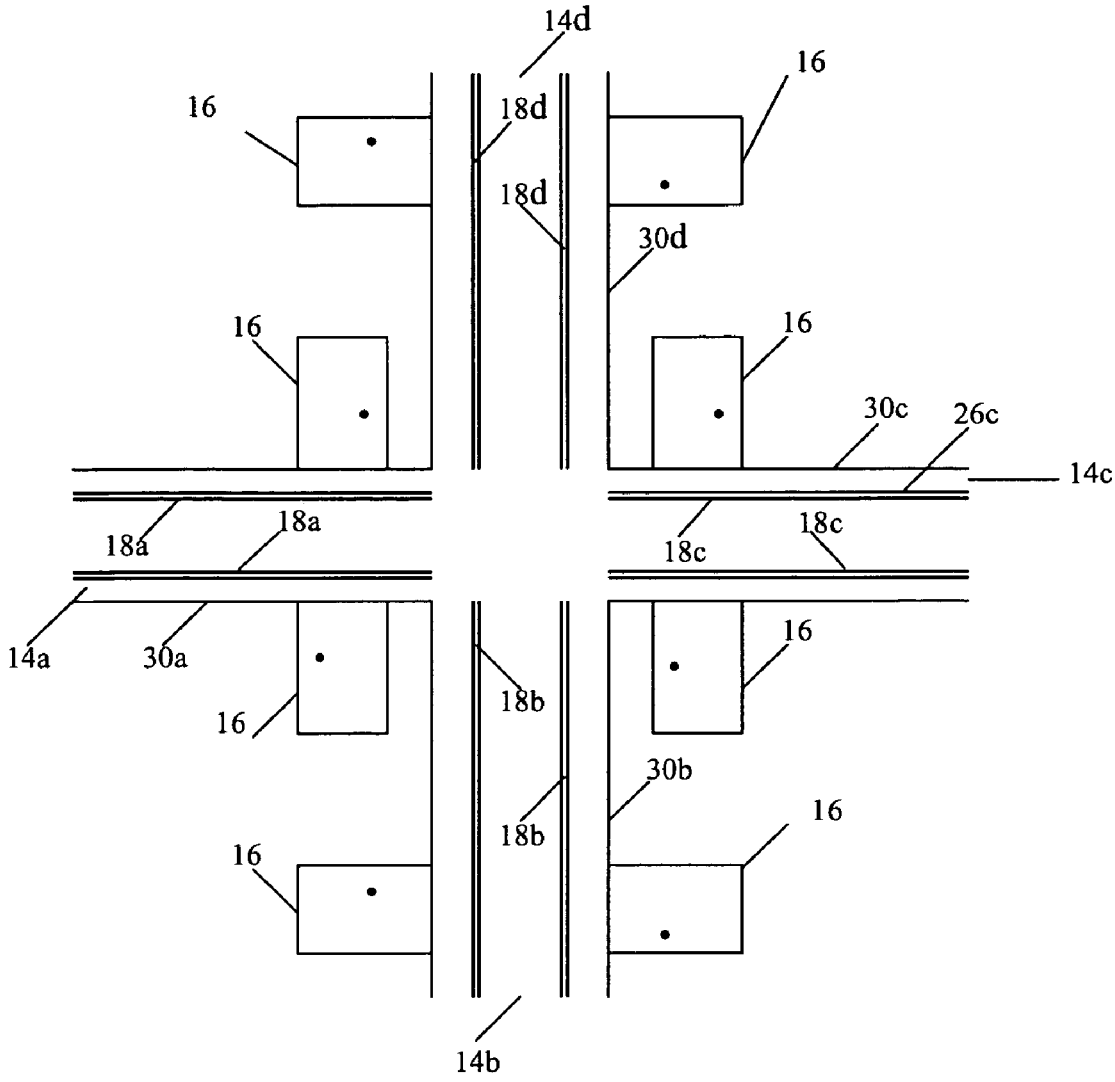
FIG. 3 is a schematic diagram of a plurality of tray sensing devices associated with a plurality of zones.
Figure 4:
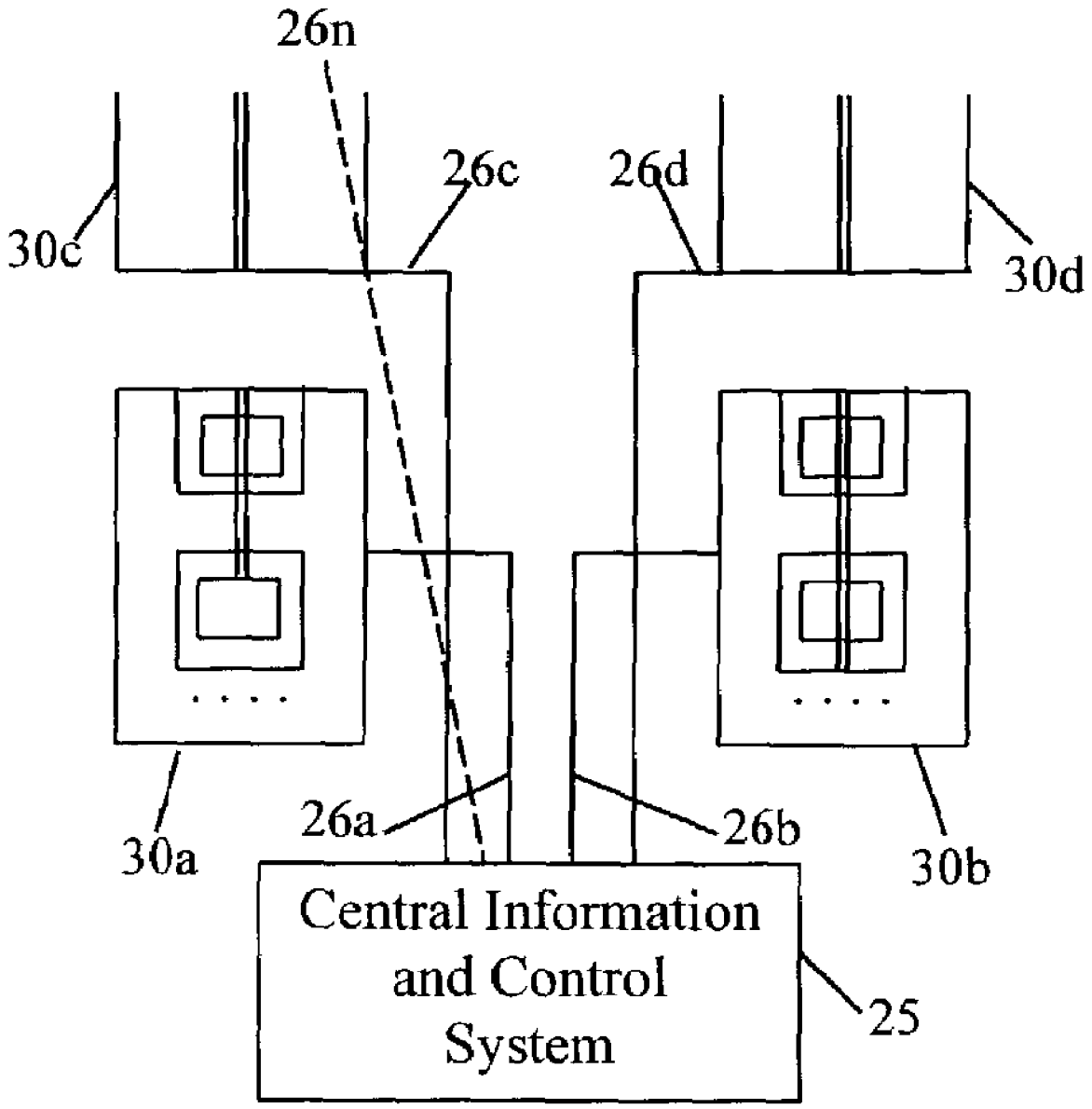
FIG. 4 is a schematic diagram of connection of the plurality of zones to a central information system.

A plurality of tray sensing devices 18*a–d* can be associated with the presence or absence of a plurality of trays 12 at various zones 30*a–d*, as shown in FIG. 3. Zones 30*a–*30*d* can be associated with one or more hallways 14*a–*14*d* or a portion of hallways 14*a–*14*d*. Zones 30*a–*30*d* can also be associated with different floors of a building, such as a hotel. It will be appreciated that any number of zones 30 can be determined depending on the configuration of the building and any number of tray sensing devices can be associated with the determined number of zones. Tray sensing devices 18*a*–18*d* of respective zones 30*a*–30*n* can relay information to central information system 25 over communication paths 26*a*–*d*, as shown in FIG. 4. Central information system 25 can receive information from respective zones 30*a*–30*n* and generate one or more alarms 27 associated with each of the respective zones 30*a*–30*n*.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

What is claimed is:

1. A method for monitoring a tray activity in a hallway comprising the steps of:

placing the tray in a vicinity of a tray sensing device said tray sensing device is an antenna adapted to be positioned along said hallway;

a tray sensor coupled to a surface of said tray; and wherein said antenna reads said tray sensor to determine the presence or absence of said tray in said hallway for detecting the presence of the tray in said hallway with the tray sensing device.

2. The method of claim 1 further comprising the step of: forwarding information from said tray sensing device indicating the presence of said tray at said given location to a central information system.

3. The method of claim 2 further comprising the step of: activating an alarm at said central information system upon receipt of said information from said sensing device.

4. The method of claim 3 further comprising the step of: deactivating said alarm upon receipt of second information from said sensing device indicating the absence of said tray at said given location.

5. The method of claim 3 further comprising the step of: continuing to forward said information from said sensing device while said tray is at said given location until said tray is removed from said given location and deactivating said alarm when said information is no longer forwarded.

6. The method of claim 3 further comprising the step of deactivating said alarm upon dispatching of personnel to said given location.

7. The method of claim 1 wherein said tray sensing device and said tray sensor is respectively either a transmitter or a receiver for sending or receiving a signal.

* * * * *